United States Patent [19]

Smith et al.

[11] 4,311,584

[45] Jan. 19, 1982

[54] AMINE FLOTATION OF CHROMITE FROM ACIDIC PULPS

[75] Inventors: Gregory E. Smith, Salt Lake City; Jerry L. Huiatt, Murray; Monte B. Shirts, S. Jordan, all of Utah

[73] Assignee: The United States of America as represented by the Secretary of the Interior, Washington, D.C.

[21] Appl. No.: 206,246

[22] Filed: Nov. 12, 1980

[51] Int. Cl.[3] ..... B03D 1/02; B03B 7/00

[52] U.S. Cl. ..... 209/12; 209/166

[58] Field of Search ..... 209/166, 167, 12, 3, 209/18

[56] References Cited

U.S. PATENT DOCUMENTS

| | | | |
|---|---|---|---|
| 2,014,404 | 9/1935 | Weed | 209/166 |
| 2,173,909 | 9/1939 | Kritchervsky | 209/166 |
| 2,412,217 | 12/1946 | Havens | 209/166 |
| 3,473,656 | 10/1969 | Sel | 209/165 X |
| 3,951,786 | 4/1976 | Petrovich | 209/166 |
| 4,225,428 | 9/1980 | Petrovich | 209/166 |

FOREIGN PATENT DOCUMENTS

| | | | |
|---|---|---|---|
| 1021302 | 12/1977 | Fed. Rep. of Germany | 209/166 |

OTHER PUBLICATIONS

Chem. Abst., 69, 1968, 793464.

Chem. Absts., 78, 1973, 128755C

Inst. min. metall, trans, sort C., 1973 82 Dec. 207, 13 Sob. esat et al.

*Primary Examiner*—Robert Halper

*Attorney, Agent, or Firm*—William Brown; Donald Gardiner

[57] ABSTRACT

Chromium values are recovered from pulverized chromite ore by agitating and aerating an aqueous pulp of said pulverized chromite ore containing an amine collector at a pulp acidity less than 2.5; and recovering a chromite containing froth as a concentrate.

5 Claims, No Drawings

AMINE FLOTATION OF CHROMITE FROM ACIDIC PULPS

BACKGROUND OF THE INVENTION

1. Field of the Invention

The present invention relates to a method of beneficiating chromite ores by froth flotation. More particularly, the present invention involves the froth flotation of chromite ores with an amine flotation reagent.

2. Description of the Prior Art

Because chromium ore is a strategic mineral, substantial interest is involved in practical methods of extracting chromium ore values from domestic chromium ore sources. There are two general types of methods for separating chromium ore (chromite) values from associated gangue minerals by froth flotation techniques. In the first method chromite ore which has been deslimed is subjected to flotation at a pH of 1.5 to 5.5 with a long chain fatty acid collector as shown in U.S. Pat. No. 2,412,217. The selectivity of the process is enhanced by the inclusion of a soluble fluoride ion containing compound such as hydrofluoric acid, sodium fluoride or sodium silicofluoride in the flotation medium. The flotation process is typically conducted by adding 0.5 to 5.0 pounds fatty acid, 0.1 to 10.0 pounds soluble fluoride ion and 1.0 to 11.0 pounds sulfuric acid per ton of ore to the aqueous treatment medium containing the chromite ore. A typical product obtained by such a process from an ore containing 25.2% $Cr_2O_3$ is a recleaner concentrate containing 41.0% $Cr_2O_3$ and 2.5% $SiO_2$ with a chromium recovery of 77.0%. In the second technique as shown in U.S. Pat. No. 3,473,656 chromite ore flotation is achieved with an undeslimed ore at a pH of 11.5 using a long chain fatty acid collector. The pH of the pulp is adjusted with NaOH with the pulp being dispersed by sodium silicate using carboxymethylcellulose as a flocculating depressant for silicate gangue minerals. Typically during processing, three pounds of sodium silicate, from 1.0 to 3.0 pounds of tall oil and from 0.25 to 0.50 pounds of carboxymethylcellulose per ton of ore, are added to a processing solution. From an ore containing 18.13% $Cr_2O_3$ and 23.98% $SiO_2$, a flotation concentrate was obtained containing 52.16% $Cr_2O_3$ and 3.72% $SiO_2$ with a chromium recovery of 80.0%. However, the conventional flotation methods involving fatty acid collectors have had a number of disadvantages among which is the relative poor selectivity of the flotation processes. Because of the selectivity problems, selectivity assisting reagents have had to be used in these processes. Fatty acid collectors are also very sensitive to slimes generated during aqueous beneficiation so that the ore must be thoroughly deslimed before flotation can be accomplished. Even with efficient desliming of the ore, however, the fatty acid flotation methods are characterized by substantial reagent consumption which adversely affects the economics of such processes. Moreover, all of the fatty acid methods require the use of silicate depressants such as soluble fluoride containing compounds, starches and the like, to increase selectivity. However, the use of fluoride ion containing compounds is unacceptable environmentally. Fatty acid chromite ore flotation techniques are also characterized by a very high reagent consumption which gives rise to unfavorable process economics. The interaction between fatty acid collectors and depressants for siliceous gangue is such that control of the flotation process is somewhat difficult.

Some attempts have been made for alternative methods of beneficiating chromite ores such as by amine flotation. In one such method as disclosed by S. Sobieraj et al. in *Inst. Min. Metall.*, Trans. Sect. C, 1973 82 (December) 207, 13 chromite ore containing serpentine and olivine is subjected to flotation at an initial pH of 12.0 with an amine collector for the removal of serpentine followed by flotation of chromite at a pH of 3.0 with the same amine collector. Experimentation showed the best acting amine collectors to be amines with carbon chain lengths of 8 to 10. In a typical procedure 0.8 pound of amine collector is added to the flotation step, while 0.6 pound of amine collector is added to the flotation medium per ton of ore in the serpentine flotation step, while 0.6 pound of amine collector is added to the medium in the chromite flotation step. From an ore containing 36.0% $Cr_2O_3$, a flotation concentrate was obtained containing 45.4% $Cr_2O_3$ representing a chromium recovery of 87.0%. Assessment of the purity of the concentrate is impossible because no corresponding silicate content is shown. A need therefore continues to exist for an improved method of flotation of chromite ore which leads to greater efficiency of chromite ore extraction and less consumption of process reagents.

SUMMARY OF THE INVENTION

Accordingly, one object of the present invention is to provide a more efficient method of recovering chromite values from chromite bearing ores, especially low grade ores.

Another object of the present invention is to provide a method of recovering high-grade chromite concentrates simply and economically from chromite bearing ores.

Briefly, these objects and other objects of the present invention as hereinafter will become more readily apparent can be attained in a method for recovering chromium values from a pulverized chromite ore by agitating and aerating an aqueous pulp of the pulverized chromite ore containing an amine collector at a pulp acidity less than 2.5, and recovering a chromite containing froth as a concentrate.

DETAILED DESCRIPTION OF THE PREFERRED EMBODIMENTS

The forth flotation, chromite ore recovery process of the present invention can be employed for the recovery of chromium values from any grade of chromite bearing ore. However, the method of the invention is particularly useful in recovering chromite from such low-grade chromite ore as those found in the Stillwater Complex in Montana, USA.

Prior to separation of the chromium values in the ore by froth flotation, a particulate mass is formed by grinding the ore. The particulate mass is then deslimed, if necessary, by conventional methodology to free the pulverized material of particles having a diameter less than 10 microns. In order to achieve maximum flotation of chromite particles in the flotation step, the particles of the pulverized ore should not be finer than 10 microns, preferably 30 microns. Therefore, in order to obtain a pulverized ore of this particle size range it may be necessary to remove particles finer than 10 microns by hydroclassification. On the other hand, the maximum particle size should not exceed 210 microns.

Following pulverization of the chromite bearing ore, the ore is pulped by conventional procedures. In a preferred embodiment, the pulp contains from 24% to 29% solids by weight. in an important feature of the process, the acidity of the pulp is adjusted to a pH of less than about 2.5 with sulfuric acid. Pulp preparation is completed by the addition of an appropriate amine collector to the pulp in an amount sufficient to achieve flotation of the chromite values in the froth flotation step. Normally, from 0.5 to 1.0 pound of amine collector is added to one ton of core.

Preferred amine collectors which can be added to the aqueous pulp are primary coco-amine collectors. Other suitable amines include primary amines, ether primary amines and ether diamines having a $C_8$–$C_{18}$ carbon atom content.

Froth flotation of the prepared pulp is conducted by standard flotation techniques in conventional flotation apparatus. Air or another suitable gas is passed through the pulp for a time sufficient to provide a froth bearing chromite particles, generally for a period of several minutes. Following separation of the froth, additional amine collectors can be added to the pulp and flotation is repeated. Flotation can be done for as many times as deemed necessary.

The following is representative of a general procedure on a laboratory scale for achieving chromite separation by the process of the present invention. Chromite ore is ground to the desired flotation feed size in a conventional apparatus such as a ball mill. If necessary, pulverized ore can be deslimed in a beaker by decantation aided by sodium silicate and sodium phosphate dispersants. The pulverized ore is pulped in water to the extent of 24% to 29% solids in a laboratory flotation cell, and the pH of the aqueous pulp is adjusted to a value less than 2.5 with sulfuric acid. Thereafter, an amine collector is added to the pulp followed by a conditioning period of 0 to 1 minute and a chromite float of 2 to 8 minutes. Collector addition and chromite flotation can be repeated as many times as necessary until all the chromite is flotated with the total amount of amine collector addition ranging from 0.5 to 1.0 pounds of reagent per ton of feed. The rougher grade chromite concentrate obtained can be cleaned by reflotation for about 10 minutes at a pH less than 2.5 and 20% solids with no additional collector.

The principal advantages of the process of the present invention are: (1) The flotation procedure is simplified. (2) No selectivity assisting reagents need be added to the pulp. (3) Consumption of the amine collector is substantially reduced in comparison to known prior art procedures. (4) A high grade chromite concentrate containing small amounts of silica is produced. (5) The flotation procedure can be used to upgrade the quality of low-grade chromite ores and gravity concentrates.

Having generally described the invention, a further understanding can be obtained by reference to certain specific examples which are provided herein for the purpose of illustration only and are not intended to be limited unless otherwise specified.

EXAMPLE 1

Four 500-gram samples of minus 10 mesh chromite ore (containing, in percent, 30.2 $Cr_2O_3$ and 15.6 $SiO_2$) and having serpentine and pyroxene as silicate gangue minerals were ground through a particle size of 100 mesh (standard Tyler screen), deslimed to a minimum 30-micron particle size, and pulped to 24 percent solids in a Galigher flotation cell. The pH was adjusted to 3.5, 2.5, or 2.0 with 23.1, 24.9, and 33.8 pounds $H_2SO_4$, respectively, per ton of ore in the three tests and to pH 2.0 with 43.0 pounds HCl per ton of ore in the fourth test. In all tests a rougher concentrate was floated in 3 stages. Each stage consisted of a minute conditioning period with 0.2 pound primary coco-amine collector (trade name Armac C) per ton of ore followed by 2 minutes of flotation. Total collector addition was 0.6 pound Armac C per ton of ore. Petrographic examination of the chromite mineral showed that the maximum attainable grade for this ore is approximately 49 percent $Cr_2O_3$.

TABLE 1

ROUGH CHROMITE FRACTION FLOTATION

| pH modifier | pH | Assay, wt-pct $Cr_2O_3$ | Assay, wt-pct $SiO_2$ | Distribution pct $Cr_2O_3$ |
|---|---|---|---|---|
| $H_2SO_4$ | 3.5 | 29.9 | 13.4 | 12.4 |
| $H_2SO_4$ | 2.5 | 40.9 | 5.6 | 75.6 |
| $H_2SO_4$ | 2.0 | 41.2 | 5.6 | 76.8 |
| HCl | 2.0 | 23.4 | 18.4 | 7.5 |

EXAMPLE 2

One thousand grams of minus 10 mesh chromite ore (containing, in percent, 16.3 $Cr_2O_3$ and 20.8 $SiO_2$) with serpentine and enstatite in the gangue was ground through a particle size of 100 mesh, deslimed to a minimum 30-micron particle size and pulped to 27 percent solids in a Fagergren flotation cell. Flotation procedure and reagent consumptions used in Example 1 were repeated except that each of the rougher floats were at pH 2.0 for 3 minutes and a total of 26.6 pounds $H_2SO_4$ per ton of ore was consumed. The maximum attainable grade for this ore is approximately 45 percent $Cr_2O_3$.

TABLE 2

CHROMITE FLOTATION

| Product | Assay, wt-pct $Cr_2O_3$ | Assay, wt-pct $SiO_2$ | Distribution, pct $Cr_2O_3$ | Distribution, pct $SiO_2$ |
|---|---|---|---|---|
| Rougher Concentrate | 40.1 | 4.4 | 78.6 | 65. |

EXAMPLE 3

The same ore used in Example 2 was preconcentrated by gravity techniques to a product containing, in percent, 42.4 $Cr_2O_3$ and 2.8 $SiO_2$. The gravity concentrate was 100 percent minus 20 mesh. A 300-gram sample was ground through to a particle size of 100 mesh and pulped to 25 percent solids in a Denver flotation cell. The flotation procedure was identical except that the total time for a 2-stage rougher was 14 minutes. Reagent consumption was, in pounds reagent per ton of gravity product, 0.8 Armac C and 18.0 $H_2SO_4$.

TABLE 3

FLOTATION OF A CHROMITE GRAVITY PRODUCT

| Product | Assay, wt-pct $Cr_2O_3$ | Assay, wt-pct $SiO_2$ | Distribution pct $CR_2O_3$ |
|---|---|---|---|
| Rougher Concentration | 43.9 | 1.6 | 94.2 |

EXAMPLE 4

One thousand grams of chromite ore (containing, in percent, 19.2 $Cr_2O_3$ and 21.0 $SiO_2$) with serpentine and enstatite as the major gangue minerals was ground through to a particle size of 100 mesh, deslimed at 20-micron particle size and pulped to 29 percent solids in a Fagergren flotation cell. The flotation procedure was identical to that used in Example 1 except the total time for a 2-stage rougher at pH 2.0 was 10 minutes. Reagent consumption was, in pounds of reagent per tone of ore, 1.0 Armac C and 30.5 $H_2SO_4$. The rougher product was cleaned in a 10 minute float at pH 2.0 using an additional acid dosage of 3.0 pounds $H_2SO_4$ per ton of ore. The maximum attainable grade for this ore is approximately 46 percent $Cr_2O_3$.

TABLE 4

| CHROMITE FLOTATION | | | |
|---|---|---|---|
| | Assay, wt-pct | | Distribution |
| Product | $Cr_2O_3$ | $SiO_2$ | pct $Cr_2O_3$ |
| Rougher concentrate | 40.3 | — | 89.1 |
| Cleaner concentrate | 43.2 | 2.2 | 85.7 |

EXAMPLE 5

The same ore used in Example 4 was preconcentrated by gravity techniques to a product containing, in percent, 40.5 $Cr_2O_3$ and 4.45 $SiO_2$. The gravity concentrate was 100 percent minus 20 mesh. A 750-gram sample was ground through to a particle size of 100 mesh and pulped to 29 percent solids in a Denver flotation cell. Flotation procedure was identical except the total time for a 2-stage rougher at pH 2.0 was 12 minutes. A preconditioning step at pH 2.0 for 10 minutes was included prior to collector addition on the first rougher float. Reagent consumption was, in pounds reagent per ton gravity product, 0.6 Armac C and 13.5 $H_2SO_4$. The rougher product was cleaned in an 11 minute float at pH 2.0 using an additional acid dosage of 3.2 pounds $H_2SO_4$ per ton of gravity product.

TABLE 5

| FLOTATION OF A CHROMITE GRAVITY PRODUCT | | | |
|---|---|---|---|
| | Assay, wt-pct | | Distribution |
| Product | $Cr_2O_3$ | $SiO_2$ | pct $Cr_2O_3$ |
| Rougher concentrate | 44.7 | — | 97.9 |
| Cleaner concentrate | 45.0 | 0.7 | 95.8 |

EXAMPLE 6

Four 300-gram samples of the same ore used in Example 4 were ground through to a particle size of 100 mesh deslimed at approximately 30-micron particle size and pulped to 25 percent solids in a Denver flotation cell. The flotation procedure included conditioning at pH 2.0 in the presence of Armac C collector for 0 to 20 minutes followed by a 3 minute float at pH 2.0. Collector for the second rougher was then added followed immediately by a second 4 minuted rougher float. Total reagent consumption was, in pounds reagent per ton of ore, 1.0 Armac C and 13.0 to 21.0 $H_2SO_4$.

TABLE 6

| ROUGHER CHROMITE FLOTATION | | |
|---|---|---|
| Condition time, min | Assay, wt-pct $Cr_2O_3$ | Distribution pct $Cr_2O_3$ |
| 0 | 39.6 | 63.5 |
| 1 | 39.6 | 71.3 |
| 5 | 39.9 | 79.0 |
| 20 | 41.0 | 89.6 |

EXAMPLE 7

A 1,000-gram sample of the same ore used in Example 2 was ground through a particle size of 100 mesh deslimed at 30-micron particle size and pulped to 27 percent solids in a Fagergren flotation cell. The flotation procedure involved: (1) Conditioning at pH with 5.0 with 3.0 pounds HF per ton of ore for 1 minute; (2) Conditioning with 5.0 pounds oleic acid per ton of ore for 5 minutes; and (3) One-stage rougher chromite float for 5 minutes.

TABLE 7

| CHROMITE ROUGHER FLOTATION | | | | | | |
|---|---|---|---|---|---|---|
| | Pounds per Ton | | | | Assay, wt-pct Distribution | |
| Example | HF | Oleic Acid | Armac C | $H_2SO_4$ | $Cr_2O_3$ | pct $Cr_2O_3$ |
| 7 | 3.0 | 5.0 | — | — | 40.1 | 74.6 |
| 2 | — | — | 0.6 | 26.6 | 40.1 | 78.6 |

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method for recovering chromite from pulverized lowgrade chromite ore having a particle size not finer than 30 microns, consisting essentially of:

agitating and aerating an aqueous pulp of said chromite ore containing a primary coco-amine collector, said pulp having an acidity adjusted to less than 2.5 by means of sulfuric acid; and recovering a chromite-containing froth as a concentrate.

2. The method of claim 1, which further comprises prior to said aerating step, conditioning said pulverized chromite ore at a pH less than 2.5.

3. The method of claim 1, wherein from 0.5 to 1.0 lbs of amine collector per ton of ore is added to said aqueous pulp.

4. The method of claim 1, wherein said aqueous pulp is formed by mixing 24 to 27 pounds of chromite ore per 76 to 73 pounds of water.

5. The method of claim 1, wherein said pulverized ore prior to froth flotation is deslimed in water.

* * * * *